United States Patent [19]

Kamada et al.

[11] Patent Number: 4,484,162

[45] Date of Patent: Nov. 20, 1984

[54] MICROWAVE OSCILLATOR

[75] Inventors: Hiroshi Kamada; Akira Takayama, both of Soma, Japan

[73] Assignee: Alps Electric Co., Ltd., Tokyo, Japan

[21] Appl. No.: 405,349

[22] Filed: Aug. 5, 1982

[30] Foreign Application Priority Data

Aug. 7, 1981 [JP] Japan ..... 56-117435[U]

[51] Int. Cl.[3] ..... H01P 7/10

[52] U.S. Cl. ..... 333/219; 333/202; 333/235

[58] Field of Search ..... 333/202, 204–205, 333/219, 227–233, 235, 245, 246; 29/600; 331/96–102, 107 DP, 107 SL

[56] References Cited

U.S. PATENT DOCUMENTS 3,840,828 10/1974 Linn et al. ..... 333/73 S 4,019,161 4/1977 Kimura et al. ..... 333/219

4,028,652 6/1977 Wakino et al. ..... 333/235

*Primary Examiner*—Marvin L. Nussbaum

*Attorney, Agent, or Firm*—Guy W. Shoup; Gerard F. Dunne

[57] ABSTRACT

In a microwave oscillator having a metal frame which defines a cavity portion, a dielectric resonator which is received in the cavity portion, a trimmer plate which opposes to the dielectric resonator in the cavity portion, a flat plate which closes one open end face of the cavity portion and to which the trimmer plate is movably attached; the improvement wherein the cavity portion has a second open end face, and this open end face is closed by a second flat plate to which the dielectric resonator is fastened. The dielectric resonator is readily assembled, and the parallelism between the dielectric resonator and the trimmer plate is readily established.

12 Claims, 4 Drawing Figures

MICROWAVE OSCILLATOR

BACKGROUND OF THE INVENTION

The present invention relates to a microwave oscillator, and more particularly to improvements in a microwave oscillator wherein a dielectric resonator is received in a cavity portion formed in a metal frame.

As will be described later in detail, a prior-art microwave oscillator of the type specified above is such that the cavity portion itself is open at one end. The structure involves economic disadvantages and an inferior manufacturing efficiency.

SUMMARY OF THE INVENTION

An object of the present invention is to provide a microwave oscillator free from the drawbacks stated above.

According to the present invention, a cavity portion itself is open at two ends. More specifically, in one aspect of performance of the present invention, a microwave osicllator wherein a dielectric resonator is received in a cavity portion formed in a metal frame comprises a first flat plate to which said dielectric resonator is fastened, and a second flat plate on which a trimmer plate for finely adjusting an oscillation frequency of the microwave oscillator is movably mounted, the metal frame having the cavity portion with two opposing open end faces, said open end faces being respectively closed by said first and second flat plates, said dielectric resonator and said trimmer plate received in said metal frame being opposite to each other within said cavity portion.

BRIEF DESCRIPTION OF THE DRAWINGS

FIG. 1(A) is a partial sectional view of a metal frame in a prior art, while FIG. 2(A) is a partial sectional view of a metal frame according to the present invention, while FIG. 2(B) is a sectional view of the essential portions of a microwave oscillator according to the present invention.

DETAILED DESCRIPTION OF THE INVENTION

Figure 1A:
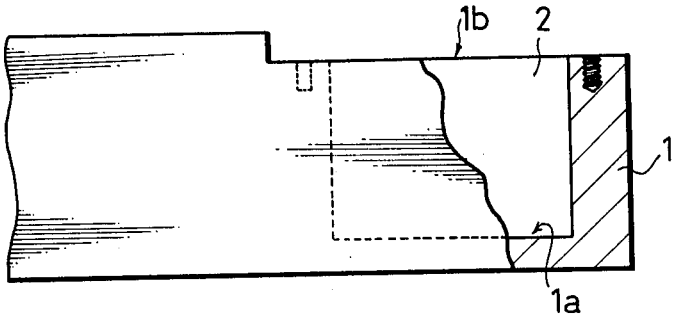
Fig.1(A) PRIOR ART
Figure 1B:
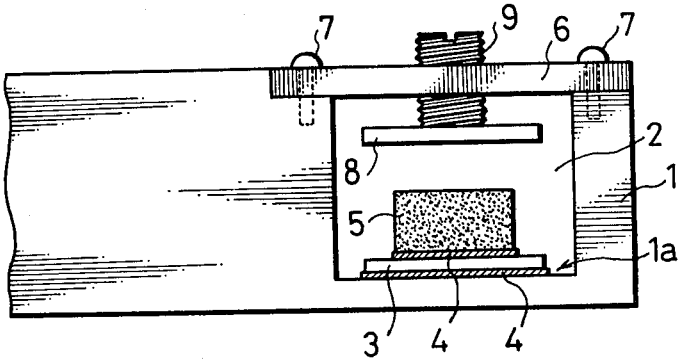
Fig.1(B) PRIOR ART
FIG. 1(B) is a sectional view of the essential portions of a microwave oscillator in the prior art.

Before the description of a preferred embodiment of the present invention, a prior art device will be explained in detail. The prior-art microwave oscillator has a structure as shown in FIG. 1(B). As illustrated in FIG. 1(A), a metal frame 1 is formed with a cavity portion 2 having one open end face and has its inner bottom 1*a* machined to be flat. A ceramic substrate 3 constituting a resonance circuit is bonded to the bottom 1*a* with an adhesive 4, and a dielectric resonator 5 is bonded to the ceramic substrate 3 with the adhesive 4. That is, the dielectric resonator 5 is fastened to the inner bottom 1*a* of the metal frame 1 through the layers of the adhesive 4 as well as the ceramic substrate 3. A flat plate 6 is used to close the open end side of the metal frame 1, and is fixed by screws 7. A threaded hole is provided substantially centrally of the flat plate 6, and a trimmer plate adjusting screw 9 to which a trimmer plate 8 is attached is threadably inserted in the threaded hole. The dielectric resonator 5 and the trimmer plate 8 which are thus arranged in the cavity portion 2 tightly closed by the metal frame 1 and the flat plate 6, oppose each other and are held in parallel with each other. The maximum oscillation power at an appropriate frequency can be attained in a certain relationship between the cavity portion 2 and the dielectric resonator 5. By rotating the trimmer plate adjusting screw 9 threadably mounted on the flat plate 6, the trimmer plate 8 is moved in the vertical direction, and the distance between the trimmer plate 8 and the dielectric resonator 5, that is, the resonator length is changed. On the basis of this fact, the oscillation frequency can be varied.

In the prior-art microwave oscillator having such structure, when the dielectric resonator 5 and the trimmer plate 8 are parallel, the distortion of an electric field is little and the loss of power is also little, so that both the constituents 5 and 8 are required to have a high degree of parallelism. It is therefore necessary to fabricate the metal frames 1 having equal degrees of parallelism between the inner bottoms 1*a* thereof, which must be machined from the open end side, and the end faces 1*b* thereof for mounting the flat plates 6. The fabrication requires a high machining precision, resulting in the disadvantage of high cost. In addition, the dielectric resonator 5 is fastened to the metal frame 1 with the adhesive 4. Therefore, when it has become necessary to exchange the dielectric resonator 5 together with the ceramic substrate 3 constituting the resonance circuit on account of, for example, a non-conforming article, there is the disadvantage that also the metal frame 1 must be discarded. In general, in the structure shown in FIG. 1(B), electrical circuit elements are concentrically disposed in the lower part of the cavity portion 2. Since this part is of small area, wiring operations including soldering etc. and bonding operations are very difficult, resulting in the disadvantage of inferior job efficiency.

The present invention has been made in order to eliminate the disadvantages described above. Hereunder, a microwave oscillator according to the present invention will be described with reference to FIGS. 2(A) and 2(B).

Figure 2:
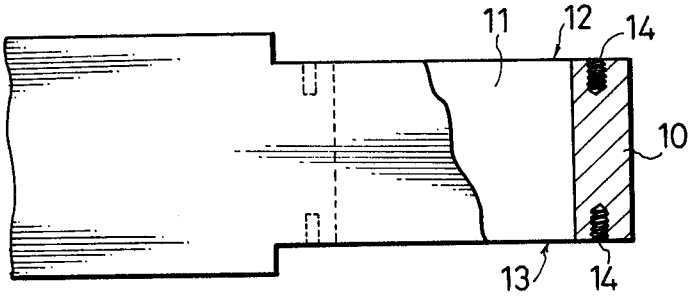
Figure 2:
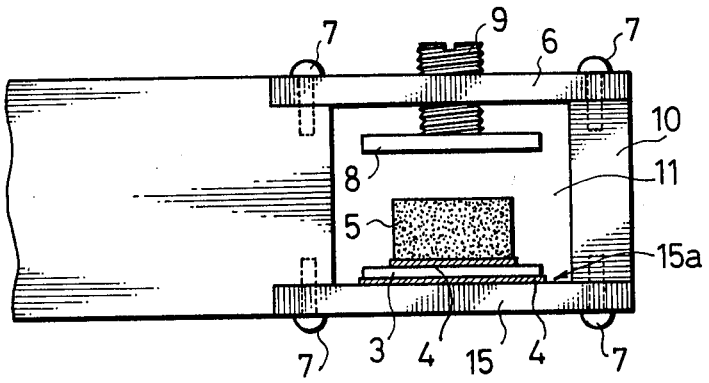

FIG. 2(A) is a partial sectional view of a metal frame according to the present invention. A cavity portion 11 which is open at both ends thereof penetrates through the metal frame 10. The open end faces 12 and 13 of the metal frame 10 are properly provided with threaded holes 14 for fixing flat plates which are to form the tightly-closed cavity portion 11.

FIG. 2(B) shows a sectional view of the essential portions of a microwave oscillator according to the present invention. In the figure, numerals 3 to 9 correspond to those in FIG. 1(B), and numerals 10 and 11 correspond to those in FIG. 2(A). Numeral 15 indicates the flat plate which is caused to abut on the open end face 13 in FIG. 2(A) and is then fixed to the metal frame 10 by the screws 7. Symbol 15*a* denotes the surface of the flat plate 15.

As explained with reference to FIG. 1(B), the trimmer plate adjusting screw 9 to which the trimmer plate 8 is attached is threadably mounted on the flat plate 6. This flat plate 6 is caused to abut on the open end face 12 in FIG. 2(A), and is then fixed to the metal frame 10 by the screws 7. The trimmer plate 8 can be moved in the vertical direction by rotating the trimmer plate adjusting screw 9, so that the resonator length can be varied at will.

The ceramic substrate 3 is bonded onto the surface 15*a* of the flat plate 15 through the adhesive 4, and the dielectric resonator 5 is bonded onto the ceramic substrate 3 through the adhesive 4. Accordingly, the dielectric resonator 5 is fastened to the flat plate 15 through the layers of the adhesive 4 as well as the ceramic substrate 3. This flat plate 15 is caused to abut on the open end face 13 in FIG. 2(A) and then fixed by the screws 7 so as to receive the dielectric resonator 5 within the cavity portion 11.

A machining operation for establishing the parallelism between the open end faces 12 and 13 of the metal frame 10 is readily performed, and the surfaces of the flat plates 6 and 15 can also be flattened by a very easy machining operation. Therefore, the dielectric resonator 5 and the trimmer plate 8 which are received in the tightly-closed cavity portion 11 are readily held parallel to each other. The operations of fastening the dielectric resonator 5 to the flat plate 15 are very easy because they are performed in the state in which the flat plate 15 is separate from the metal frame 10. Even when electrical circuit elements are concentrically disposed in the vicinity of the surface 15*a* of the flat plate 15, the assembly operations of soldering, wiring etc. are very easy because they are carried out on the mere flat plate 15 separate from the metal frame 10.

Needless to say, the peripheral surface of the open end face 13 of the metal frame 1 and the surface 15*a* of the flat plate 15 are held in close contact so as to cause no potential difference between both the surfaces.

As set forth above, according to the present invention, the microwave oscillator has the structure in which the flat plate with the dielectric resonator fastened thereto can be separated from the metal frame. Therefore, in case the assembly of the flat plate carrying the dielectric resonator is defective, the exchange of this defective flat plate suffices, and a smaller number of components may be discarded.

In assembling the ceramic substrate and the dielectric resonator, the operations can be performed on the separate flat plate irrespective of the metal frame, and the wiring is finished up merely by fixing the flat plate furnished with the assembled electric circuit, to the metal frame by the screws. Therefore, the manufacturing efficiency can be enhanced.

Since the open end faces of the metal frame can be readily machined, the parallelism between the dielectric resonator and the trimmer plate which are received in the cavity portion is easily established, and the occurrence of non-conforming articles lessens.

We claim:

1. A microwave oscillator including a dielectric resonator received in a cavity portion formed in a metal frame, said frame comprising a first flat plate to which said dielectric resonator is fastened and a second flat plate on which a trimmer plate for finely adjusting an oscillation frequency of the microwave oscillator is movably mounted, the metal frame having the cavity portion with two opposing open end faces, said open end faces being respectively closed by said first and second flat plates, said dielectric resonator and said trimmer plate received in said metal frame being opposite to each other within said cavity portion, wherein said dielectric resonator is fastened to said first flat plate through a ceramic substrate and layers of an adhesive.

2. A microwave oscillator according to claim 1, wherein said dielectric resonator and said trimmer plate are axially aligned.

3. A microwave oscillator according to claim 1, wherein said first flat plate and said second flat plate are held parallel to each other.

4. A microwave oscillator including a dielectric resonator and means including a metallic frame for shielding said dielectric resonator, said frame defining a cavity having side walls closely adjacent said resonator and including a bottom plate secured to the bottom portion of said sidewalls and a top plate received to the upper portions of said side walls so as to be parallel to said bottom plate, said dielectric resonator being secured to said bottom plate through a substrate and layers of adhesive, and attachment means for enabling said bottom plate to be removed easily from said side walls.

5. A microwave oscillator according to claim 4, said attachment means including removable bolts extending through said bottom plate and into the bottom portions of said side walls.

6. A microwave oscillator according to claim 4, said top plate carrying means for adjusting the frequency of said oscillator.

7. A microwave oscillator according to claim 6, including second attachment means for enabling said top plate to be removed from said side walls.

8. A microwave oscillator according to claim 9, said second attachment means including removable bolts extending through said top plate and into the upper portions of said side walls.

9. A microwave oscillator according to claim 4, including a second attachment means for enabling said top plate to be removed from said side walls.

10. A microwave oscillator according to claim 9, said second attachment means including removable bolts extending through said top plate and into the upper portions of said side walls.

11. A microwave oscillator according to claim 4, the upper portion of one of said side walls having a step portion receiving a portion of top plate.

12. A microwave oscillator according to claim 11, the lower portion of said one side wall having a step portion receiving a portion of the bottom plate.

* * * * *